US007114865B2

(12) United States Patent
Ishii et al.

(10) Patent No.: US 7,114,865 B2
(45) Date of Patent: Oct. 3, 2006

(54) TAPE PRINTER AND TAPE MAKING METHOD

(75) Inventors: Hidekazu Ishii, Nakashima-gun (JP); Jun Itakura, Nagoya (JP); Hajime Okochi, Inazawa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 80 days.

(21) Appl. No.: 11/022,658

(22) Filed: Dec. 28, 2004

(65) Prior Publication Data

US 2005/0214053 A1 Sep. 29, 2005

(30) Foreign Application Priority Data

Mar. 26, 2004 (JP) ..... 2004-092243

(51) Int. Cl.
*B41J 11/26* (2006.01)

(52) U.S. Cl. ..... 400/615.2; 400/613; 400/706; 400/61

(58) Field of Classification Search ..... 400/615.2, 400/611, 613, 578, 586, 61, 70, 74, 76, 706, 400/709
See application file for complete search history.

(56) References Cited

U.S. PATENT DOCUMENTS 5,496,117 A * 3/1996 Sawada et al. ..... 400/61
6,092,947 A * 7/2000 Nunokawa et al. ..... 400/615.2
6,106,176 A * 8/2000 Yanagisawa et al. .... 400/615.2
6,485,208 B1 * 11/2002 Woodman et al. ..... 400/615.2

FOREIGN PATENT DOCUMENTS

| | | |
|---|---|---|
| EP | 0 654 747 A2 | 5/1995 |
| EP | 1 120 263 A2 | 8/2001 |
| JP | A 07-276746 | 10/1995 |
| JP | A 7-276746 | 10/1995 |

* cited by examiner

*Primary Examiner*—Minh Chau
(74) *Attorney, Agent, or Firm*—Oliff & Berridge, PLC

(57) ABSTRACT

After a numbering character string is input, the start position of the numbering character string to be serially incremented and the end position of the numbering character string to be repeatedly incremented and printed on a print tape are set, and the number of print tapes on which the input numbering character string is serially implemented and printed is set. In this case, a numbering character string to be printed on a first print tape and a numbering character string to be printed on a last print tape are displayed on a liquid crystal display before the start of printing.

26 Claims, 10 Drawing Sheets

FIG. 4

61

| ERROR CAUSE | ERROR-CAUSE DISPLAY DATA | ERROR-ELIMINATION DISPLAY DATA |
|---|---|---|
| EXCEEDING SET LENGTH | LENGTH ERROR | CHANGE SIZE, FONT, MARGIN VALUE, AND SET LENGTH |
| NO TAPE CASSETTE BEING LOADED, NO TAPE BEING LOADED | NO-TAPE ERROR | LOAD TAPE |
| SET NUMBER OF PRINT TAPES IS 0 OR 100 OR MORE | NUMBER-OF-PRINT-TAPES ERROR | CHANGE THE NUMBER OF PRINT TAPES |
| . . . | . . . | . . . |

SET START POSITION

SET END POSITION

SET NUMBER OF PRINT TAPES

TAPE PRINTER AND TAPE MAKING METHOD

BACKGROUND OF THE INVENTION

1. Field of the Invention

The present invention relates to a tape printer and a tape making method having a numbering function for serially incrementing numbering character strings having an arrangement sequential order, such as a numerical, alphabetical, or Japanese syllabary order, and printing the strings in units of a tape.

2. Description of Related Art

Conventionally, there have been proposed various techniques related to tape printers and tape making methods, the printers each having a numbering function for serially incrementing numbering character strings having an arrangement sequential order, such as a numerical, alphabetical, or Japanese syllabary order, and printing the strings in units of a tape.

For example, a conventional tape printer has a configuration as described herebelow (see Japanese patent application laid-open No. H07-276746 (1995-276746), for example). The configuration comprises input means for inputting characters, symbols and a variety of instructions (commands); storage means for storing data, such as characters and symbols, having been input from the input means; display means for displaying data of the storage means; and printing means for printing data, such as characters and symbols, on a tape used as a printing medium. The configuration provides functionality that serially increments a numbering character string having an arrangement sequential order of, for example, a numerical, alphabetical, or Japanese syllabary order and that prints the string in units of a tape. More specifically, the configuration further comprises specification means, setting means, and control means. The specification means specifies the numbering character strings of data stored in the storage means. The setting means sets a numbering count of the numbering character strings specified in the specification means. The control means provides on the display means distinguished displays in two cases for allowing the setting means to set the numbering count depending on whether or not the numbering character string is specified in the specification means.

Thus, in the tape printer, the distinguished displays of the numbering count setting are provided on the display means depending on whether or not the numbering character string is specified. As such, the configuration has the advantage of enabling explicit recognition regarding the existence or absence of the specification of the numbering character strings in data to be printed.

However, in the conventional tape printer, whether a desired last numbering character string is printed is not known before the string is actually printed after the user has set the numbering count. As such, problematic cases occur in which the process terminates either upon printing of numbering character string of one before a desired last numbering character string or upon printing of an unnecessary numbering character string of one after the desired last numbering character string in the sequential order. In addition, when printing a numbering character string on a tape, printing of each page is performed each time after a print buffer is renewed. For this reason, when a print-disabling condition occurs in which, for example, the number of characters cannot be printed on a tape having a set length during print operation, print output is aborted whereby to disable printing the numbering character strings to the lowest-order one thereof desired by a user.

SUMMARY OF THE INVENTION

The invention is made to solve the problems described above, and an object of the invention is to provide a tape printer and a tape making method that, before printing of numbering character strings, enable verifying a numbering character string that is to be printed on a first tape and a numbering character string that is to be printed on a last tape.

Another object of the invention is to provide a tape printer and a tape making method that, before printing of numbering character strings, enables verifying whether or not the numbering character strings can be printed on a set number of print tapes, and capable of presenting an error cause, an error elimination method, and the like when the numbering character strings cannot be printed.

To achieve the above object, the present invention provides a tape printer comprising: a tape feeding mechanism that feeds a long tape; an input device; a display device that displays printing data composed of characters, graphics, and/or the like input or edited by the input device; a printing mechanism that prints the printing data on the tape; and a control circuit that performs driving control of the printing mechanism, wherein the tape printer serially increments and prints a numbering character string having a predetermined arrangement sequential order, such as a numerical, alphabetical, or Japanese syllabary order, in units of a print tape by using the printing mechanism, wherein the control circuit comprises a processor that executes: a start-position setting process for specifying a firstly incrementing character of a numbering character string input by the input device; an end-position setting process for specifying a maximum number of repeatedly incrementable characters or maximum number of repeatedly incrementable digits of the numbering character string; a number-of-print-tapes setting process for specifying a number of print tapes on which the numbering character string is to be serially incremented and printed; and a numbering-result displaying process for displaying on the display device a numbering character string that is to be printed on a first print tape and a numbering character string that is to be printed on a last print tape.

According to the tape printer, the firstly incrementing character of the input numbering character string is specified by the start-position setting process, the maximum number of repeatedly incrementable characters or maximum number of repeatedly incrementable digits of the numbering character string is subsequently specified by the end-position setting process, and the number of print tapes on which the numbering character string is to be serially incremented and printed is subsequently specified by the number-of-print-tapes setting process. In this case, the numbering character string to be printed on the first print tape and the numbering character string to be printed on the last print tape are displayed through the display device.

Thus, the numbering character string to be printed on the first print tape and the numbering character string to be printed on the last print tape that are specified by the start-position setting process, the end-position setting process and the number-of-print-tapes setting process, respectively, are displayed via the display device. Thereby, before the start of printing of the numbering character strings, a user can verify the numbering character strings that are to be printed on the first print tape and the last print tape. This consequently enables securely preventing an excess or shortage of the number of the print tapes on which the numbering character strings are printed.

According to another aspect, the present invention provides a tape making method for serially incrementing and printing a numbering character string having a predetermined arrangement sequential order, such as a numerical, alphabetical, or Japanese syllabary order, in units of a print tape by using a tape printer that comprises a tape feeding mechanism that feeds a long tape; an input device; a display device that displays printing data composed of characters, graphics, and/or the like input or edited by the input device; a printing mechanism that prints the printing data on the tape; and a control circuit that performs drive control of the printing mechanism, the tape making method comprising: a start-position setting step of specifying a firstly incrementing character of a numbering character string input by the input device; an end-position setting step of specifying a maximum number of repeatedly incrementable characters or maximum number of repeatedly incrementable digits of the numbering character string; a number-of-print-tapes setting step of specifying a number of print tapes on which the numbering character string is to be serially incremented and printed; and a numbering-result displaying step of displaying on the display device a numbering character string that is to be printed on a first print tape and a numbering character string that is to be printed on a last print tape.

According to the tape making method, the firstly incrementing character of the input numbering character string is specified by the start-position setting step, the maximum number of repeatedly incrementable characters or maximum number of repeatedly incrementable digits of the numbering character string is subsequently specified by the end-position setting step, and the number of print tapes on which the numbering character string is to be serially incremented and printed is subsequently specified by the number-of-print-tapes setting step. In this case, the numbering character string to be printed on the first print tape and the numbering character string to be printed on the last print tape are displayed through the display device.

Thus, the numbering character string to be printed on the first print tape and the numbering character string to be printed on the last print tape that are specified by the start-position setting step, the end-position setting step and the number-of-print-tapes setting step, respectively, are displayed through the display device. Thereby, before the start of printing of the numbering character strings, a user can verify the numbering character strings that are to be printed on the first print tape and the last print tape. This consequently enables securely preventing an excess or shortage of the number of the print tapes on which the numbering character strings are printed.

BRIEF DESCRIPTION OF THE DRAWINGS

In the accompanying drawings:

FIG. 4 is an example of an error-elimination display data table stored in an error-elimination display data table storage area of a ROM (read only memory) of the tape printer according to the embodiment;

DETAILED DESCRIPTION OF THE PREFERRED EMBODIMENTS

Figure 1A:
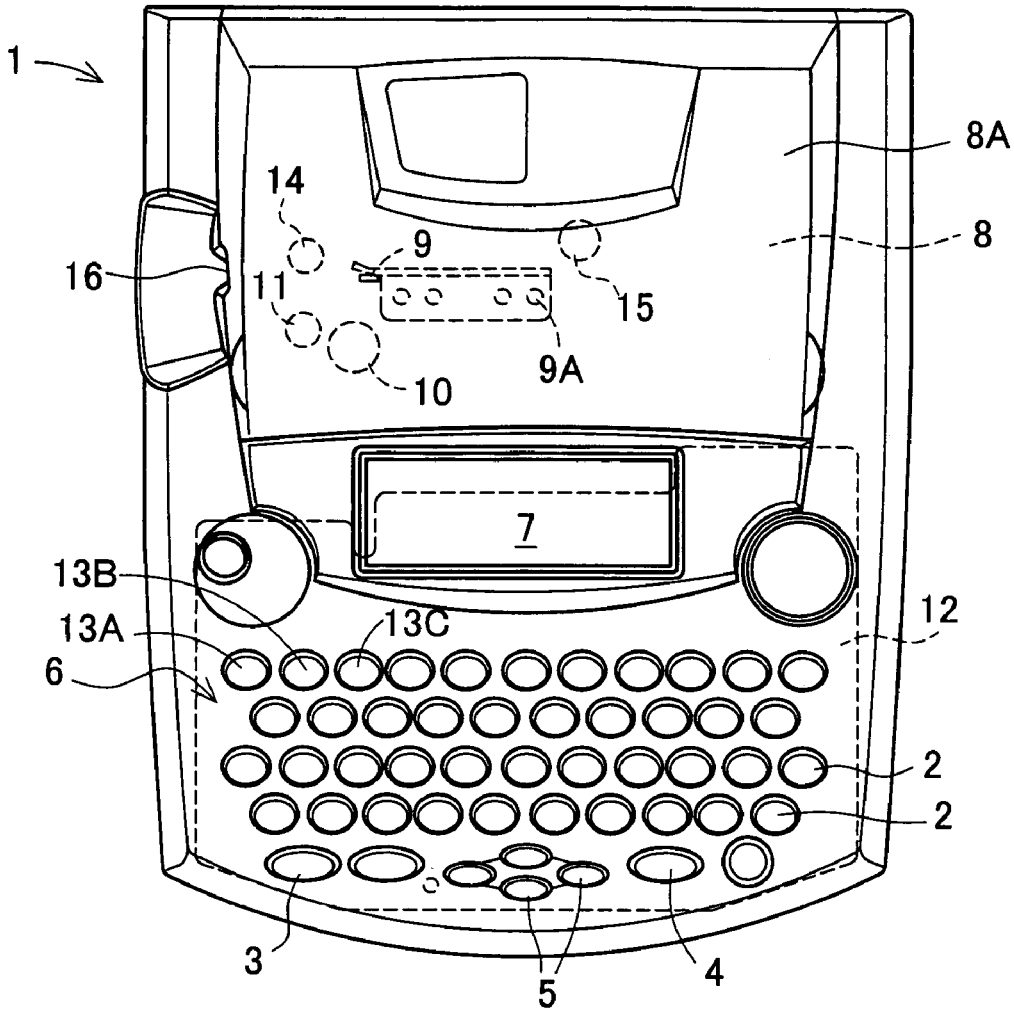
FIG. 1A is a schematic top view of a tape printer according to an embodiment of the invention.

Referring to the drawings, a tape printer and a tape making method according to the invention will each be described below in accordance with a practical embodiment.

To begin with, a schematic configuration of the tape printer according to the embodiment will be described with reference to FIGS. 1 to 4.

Figure 1B:
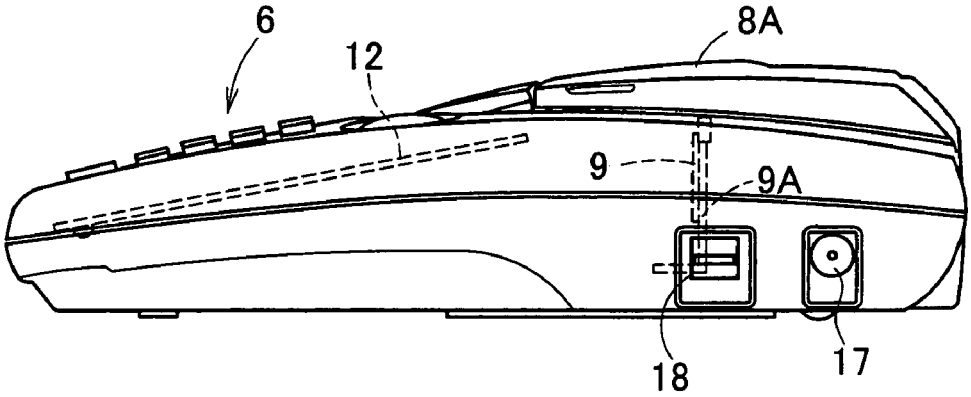
FIG. 1B is a schematic right side view of the tape printer according to the embodiment.

Referring to FIGS. 1A and 1B, the tape printer 1 according to the embodiment has a keyboard 6 and a cassette housing part 8 covered by a housing cover 8A. The keyboard 6 has various keys such as character input keys 2, a print key 3, a return key 4, a cursor key 5, a function key 13A, a length set key 13B, and a numbering key 13C. The character input keys 2 are used to create, for example, text configured of text data, and numbering character strings having an arrangement sequential order, such as a numerical, alphabetical, or Japanese syllabary order. The print key 3 is used to issue instructions for printing text and the like. The return key 4 is used, for example, to issue return instructions, to execute various processes, and to issue instructions for selections. The cursor key 5 is used to move a cursor up and down and left and right on a LCD 7, which displays a plurality of lines of characters. The function key 13A is depressed in the event of selection of various functions described below. The length set key 13B is pressed after depression of the function key 13A in the event of changing the setting of the tape length on which numbering character strings are to be printed as described below. The numbering key 13C is depressed after depression of the function key 13A in the event of inputting a numbering character string and setting a print output format, as described below. The cassette housing part 8 is provided to house a tape cassette 21 described below in detail (see FIG. 2). A control substrate 12 on which a control circuit 40 (see FIG. 3) is formed is disposed below the keyboard 6. A label exit slot 16 from which printed tapes are fed out is formed in a left-hand sidewall portion of the cassette housing part 8. A righthand sidewall portion of the cassette housing part 8 is formed with an adapter insertion slot 17 in which a power adapter is mounted, and a connector 18 for connection of a cable such as a USB (universal serial bus) cable that is connected to a personal computer (not shown).

Additionally disposed in the cassette housing part 8 are a thermal head 9, a platen roller 10 opposing the thermal head 9, a tape feed roller 11 provided downstream of the platen roller 10, a tape drive roller shaft 14 opposing the tape feed roller 11, and a ribbon winding spindle 15 for feeding an ink ribbon housed inside of the tape cassette 21 and the like.

The thermal head 9 is flat in a substantially longitudinal rectangular shape in front view, wherein a front-face left-hand end part is formed with a predetermined number of heating elements R1 to Rn (in the present embodiment, n=128) aligned along a side of the lefthand end part. More specifically, the thermal head 9 is fixed with an adhesive to a front-face lefthand end part of a substantially front-view rectangular radiating plate 9A formed of, for example, a plated steel sheet or a stainless steel sheet so that the array direction of the heating elements R1 to Rn is parallel with a side of a lefthand end part of the radiating plate 9A. The radiating plate 9A is thus mounted on the downside of the cassette housing part 8 with screws and the like to cause the array direction of the heating elements R1 to Rn to be substantially perpendicular to the travel direction of a tape 36 to be printed (hereinafter, a "printing tape") (see FIG. 2) in an opening portion 32 of the tape cassette 21 (see FIG. 2).

Using an appropriate driving mechanism, the ribbon winding spindle 15 is rotatably driven by a tape feed motor 52 (see FIG. 3) configured of a below-described stepping motor or the like. The tape drive roller shaft 14 is rotatably driven by the tape feed motor 52 through an appropriate transmission mechanism, whereby to rotatably drive a below-described tape drive roller 33 (see FIG. 2).

Figure 2:
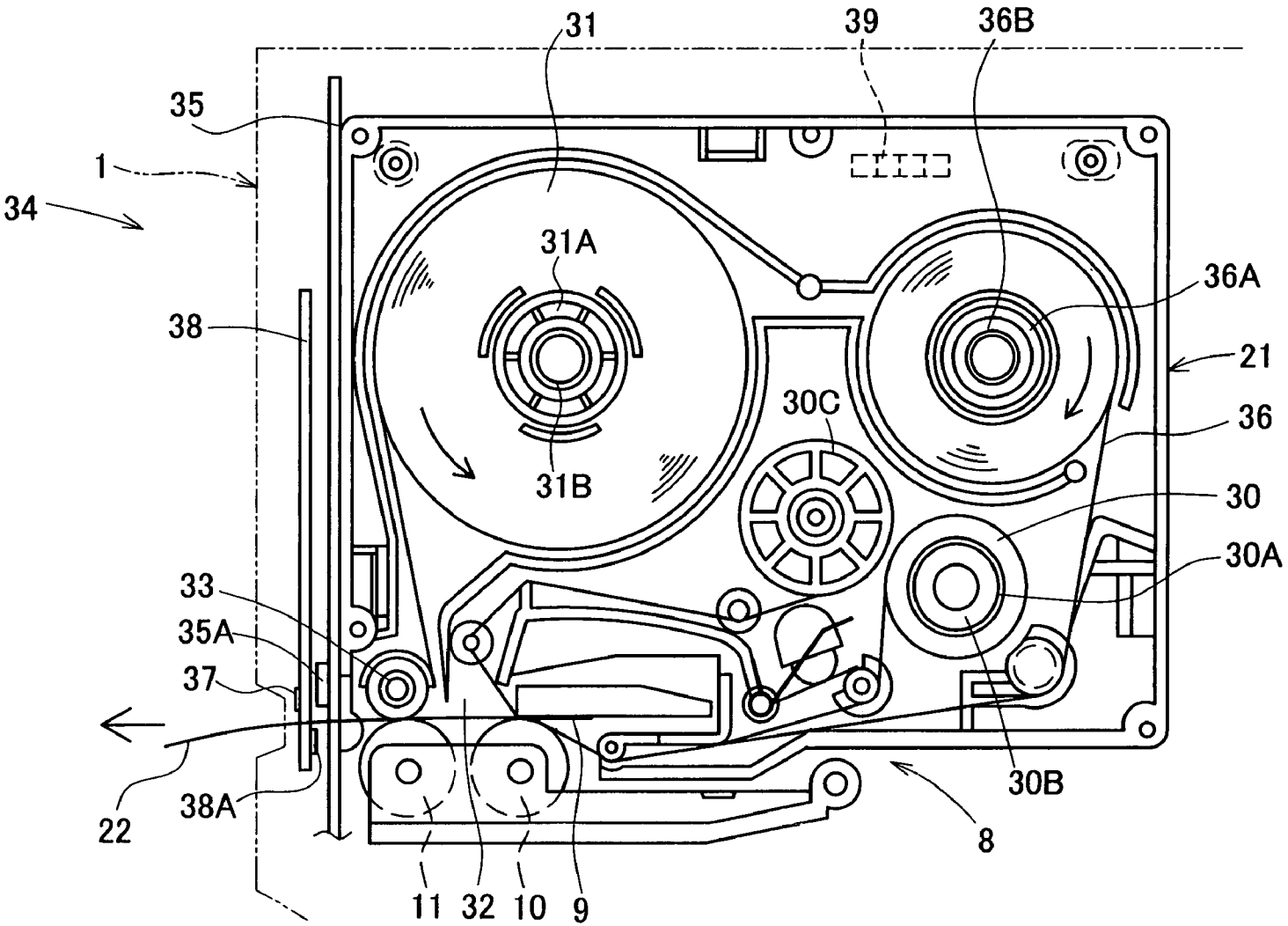
FIG. 2 is a plan view of the tape printer according to the embodiment in a state where a cover of a tape cassette mounted in the tape printer is demounted.

The following will now describe a schematic configuration in a case where the tape cassette 21 is mounted in the cassette housing part 8 of the tape printer 1, with reference to FIG. 2.

As is shown in FIG. 2, the tape cassette 21 is formed to store the printing tape 36 formed of a transparent tape or the like, an ink ribbon 30 used for printing on the printing tape 36, and a double-sided adhesive tape 31 that is backed to the printed printing tape 36. The tape 36, the ribbon 30, and the tape 31 are, respectively, wound on a tape spool 36A, a reel 30A, and a tape spool 31A, and are rotatably fitted on a cassette boss 36B, a reel boss 30B, and a cassette boss 31B that are protrusively formed on a bottom wall of the tape cassette. The tape cassette 21 further has an ink ribbon takeup reel 30C that takes up a spent strip of the ink ribbon 30.

An unspent part of the ink ribbon 30A wound on the reel 30A and withdrawn from the reel 30A overlaps the printing tape 36, and the ink ribbon 30A (unspent part) together with the printing tape 36 enters an opening portion 32 and then passes between the thermal head 9 and the platen roller 10. Then, the ink ribbon 30 released or separated from the printing tape 36 advances to the ink ribbon takeup reel 30C, which is rotatably driven with the ribbon winding spindle 15, and is wound thereonto by the ink ribbon takeup reel 30C.

The double-sided adhesive tape 31 is wound on the tape spool 31A and stored therewith in a state where one side (surface) of the double-sided adhesive tape 31 is overlapped with a release paper being on the outside. The double-sided adhesive tape 31 withdrawn from the tape spool 31A passes between the tape drive roller 33 and the tape feed roller 11, whereby an adherent side (surface) on the side with which the release paper is not overlapped is adhered to the printing tape 36.

Thereby, the printing tape 36 wound on the tape spool 36A and withdrawn from the tape spool 36A passes through the opening portion 32 to which the thermal head 9 of the tape cassette 21 is inserted. The printing tape 36, to which the double-sided adhesive tape 31 is adhered, is guided to pass between the tape drive roller 33 and the tape feed roller 11. The tape drive roller 33 is provided rotatable in a one-side lower portion (lower-left side portion in FIG. 2) of the tape cassette 21 and is rotated with a driving force of the tape feed motor 52, and the tape feed roller 11 is disposed opposite the tape drive roller 33. Then, the printing tape 36 is fed outside of the tape cassette 21, and a print tape 22 is ejected from the label exit slot 16 of the tape printer 1. In this case, the double-sided adhesive tape 30 is pressed and adhered by the tape drive roller 33 and the tape feed roller 11 to the printing tape 36.

The following will briefly describe a tape cutter 34 that automatically cuts the printing tape 36 with the double-sided adhesive tape 30. A plate-like supplemental frame 35 is elevationally provided in immediately inside portion of a main frame of the tape printer 1 which corresponds to the left side of the tape cassette 21, and a fixed blade 35A is upwardly fixed to the supplemental frame 35. A front-end vicinity portion of an operation lever 38 extending in a backward-forward direction is turnably supported by a left-right directional pivotally supporting axis 37 fixed to the supplemental frame 35. A movable blade 38A is mounted to oppose the fixed blade 35A in a position corresponding to a forward side from the pivotally supporting axis 37 of the operation lever 38. A rear end portion of the operation lever 38 is formed of a pivotal drive mechanism (not shown) connected to a cutting motor 54 (see FIG. 3) to be vertically pivotable. In a normal mode, the movable blade 38A is maintained spaced away from the fixed blade 35A.

The print tape 22, on which printing has been performed by the thermal head 9 and to which the double-sided adhesive tape 30 has been press-adhered, is guided from the tape cassette 21 to pass between the fixed blade 35A and the movable blade 38A and to extend out from the label exit slot 16. As such, the rear end portion of the operation lever 38 is vertically pivoted through the pivotal drive mechanism by the cutting motor 54 driven by a cutting signal, whereby the movable blade 38A is moved close to or approaches the fixed blade 35A, and the print tape 22 is cut by the two blades 35A and 38A.

Four types of printing tapes 36 to be fed from individual tape cassettes 21 are prepared for use. The types individually have the tape widths of 6 mm, 9 mm, 12 mm, and 18 mm. To enable sensing the differences in the tape widths of the four types, a protrusion piece 39 formed of a combination of the presence and absence of four protrusion tabs is provided on a bottom wall portion of each of the tape cassettes 21. A cassette sensor 49 (see FIG. 3) for sensing the tape width from the combination of the four protrusion tabs of the protrusion piece 39 is mounted on a bottom wall portion of the cassette housing part 8 that supports the lower portion of the tape cassette 21. More specifically, in accordance with the combination of the four protrusion tabs constituting the protrusion piece 39, the cassette sensor 49 outputs a different cassette signal depending on the tape width. For example, a '0100' cassette signal is output when the tape width is 9 mm, a '1100' cassette signal is output when the tape width is 18 mm, and a '0000' cassette signal is output when no tape cassette 21 is inserted.

The circuit configuration of the tape printer 1 will now be described herebelow with reference to FIG. 3.

Figure 3:
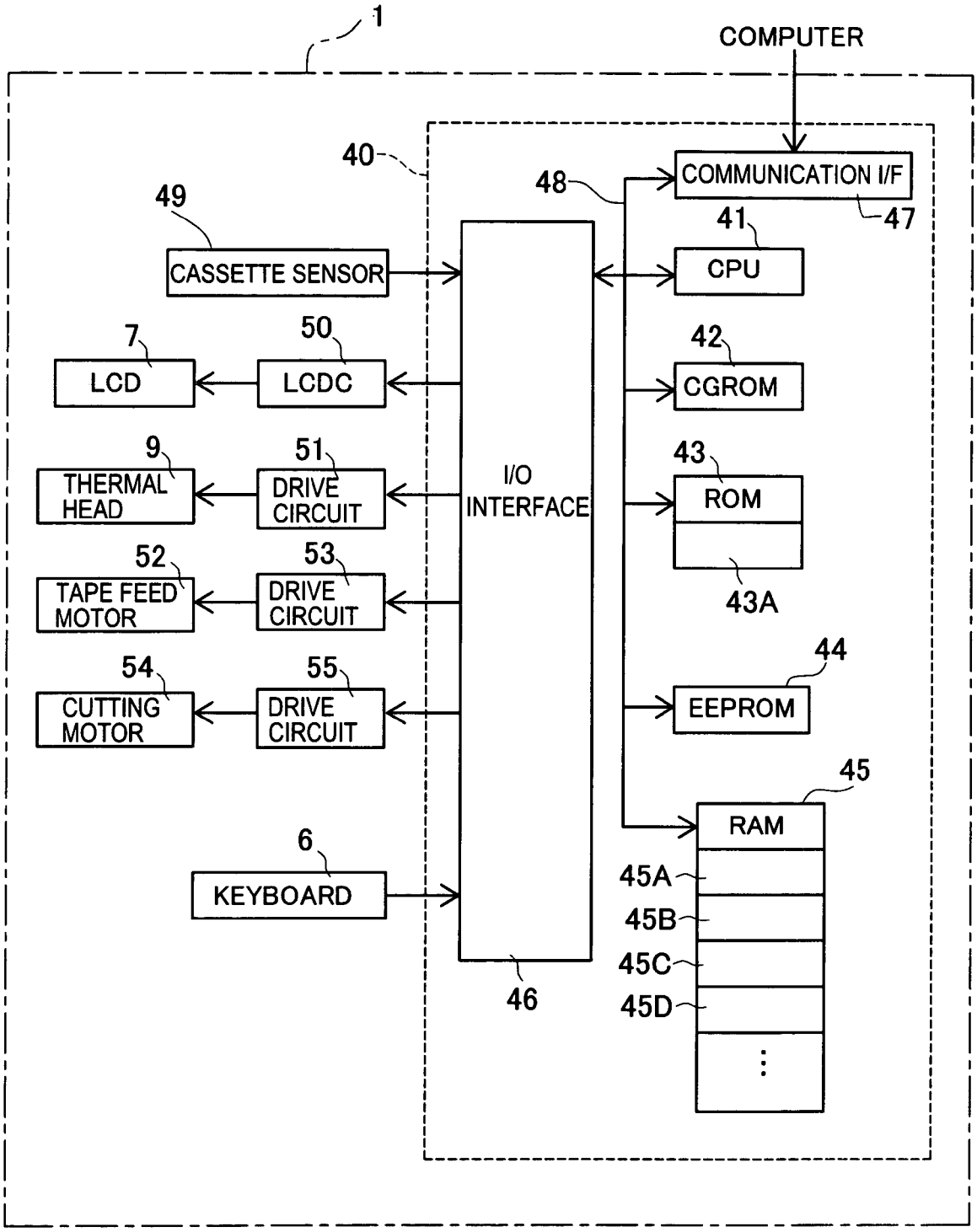
FIG. 3 is a block diagram showing a control configuration of the tape printer according to the embodiment.

Referring to FIG. 3, the control circuit 40, which is formed on the control substrate 12 of the tape printer 1, has a central processing unit 41 ("CPU"), a character generator read only memory 42 ("CGROM"), a ROM 43, a flash memory 44 (electrically erasable programmable ROM 10 ("EEPROM")), a random access memory 45 ("RAM"), an input/output ("I/O") interface ("I/F") 46, and a communication I/F 47 and the like. The CPU 41, the CGROM 42, the ROM 43, the flash memory 44, the RAM 45, the input/output I/F 46, and the communication I/F 47 are interconnected through a bus line 48, whereby intercommunication of data is performed.

Dot pattern data corresponding to individual characters are stored in the CGROM 42. Dot pattern data is read out from the CGROM 42, and a corresponding dot pattern is displayed on the LCD 7 in accordance with the dot pattern data.

The ROM 43 is used to preliminarily store various types of computer programs, such as a numbering setting process program and a length setting process program. As described below, the numbering setting process program displays an error cause and the like on the LCD 7 when input numbering character strings cannot be printed through to the last one of the set number of print tapes (e.g., labels). The length setting process program sets the print tape length on which numbering character strings are printed. In the ROM 43, an error-elimination display data table storage area 43A is provided that stores error-elimination display data tables 61 (see FIG. 4) that stores error display data and error-elimination display data displayed on the LCD 7 when a numbering character string input as setting conditions in the numbering setting process cannot be printed through to the last tape.

The CPU 41 executes various operations in accordance with the individual programs stored in the ROM 43. The ROM 43 is used to preliminarily store printing dot patterns related to individual large numbers of characters for printing various types of characters such as alphabetic characters, numeric characters, and symbols. More specifically, the printing dot patterns are classified in units of a typeface (Gothic typeface, Mincho typeface, or the like) and are stored in correlation to code data for four printing character sizes (16, 24, 32, and 48 dot sizes) in units of the typeface. Additionally stored in the ROM 43 are graphics pattern data for printing graphics images including gradient representations. Further stored in the ROM 43 are various other programs necessary for control of the tape printer 1. The programs include, for example, a display drive control program for controlling a liquid crystal display controller 50 ("LCDC") in correlation to code data of characters such as characters and numeric characters having been input from the keyboard 6, and a printing drive control program for controlling the thermal head 9 and the tape feed motor 52 in accordance with data read out from a print buffer 45A.

The flash memory 44 is used to store dot-pattern data with registration numbers being added that correspond to data, such as printing data and various graphics pattern data having been received from external computers through the connector 18. The flash memory 44 retains the storage contents even after the power of the tape printer 1 turns off.

The RAM 45 is used to temporarily store various results of operations performed by the CPU 41. The RAM 45 has various memory areas, such as the print buffer 45A, an editing input area 45B, a display image buffer 45C, and a work area 45D. In the RAM 45, data, such as applied pulse counts representing energy amounts for forming a plurality of dot patterns and individual dots for printing characters and symbols, are stored as dot pattern data. The thermal head 9 performs dot printing in accordance with the dot pattern data stored in the print buffer 45A. The editing input area 45B is used to store edited text as being label data, such as text data, having been input from the keyboard 6. The display image buffer 45C is used to store data such as graphics data that are to be displayed on the LCD 7.

The input/output I/F 46 is connected to the keyboard 6, the cassette sensor 49, the liquid crystal display controller 50 ("LCDC") having a video RAM for outputting display data to the LCD 7, a drive circuit 51 for driving the thermal head 9, a drive circuit 53 for driving the tape feed motor 52, and a drive circuit 55 for driving the cutting motor 54.

The communication I/F 46 is configured of, for example, a USB (universal serial bus) cable, and is connected to an external computer (not shown) through the USB cable or the like, whereby bidirectional data communication can be performed therebetween.

As such is the configuration, in the event that characters and the like are input through character keys of the keyboard 6, the input characters (text data) are serially stored into the editing input area 45B. Concurrently, dot patterns corresponding to the characters and the like, having been input through the keyboard 6, are displayed on the LCD 7 in accordance with dot-pattern generation control program and a display drive control program. The thermal head 9 is driven through the drive circuit 51, thereby to perform printing of dot pattern data stored in the print buffer area 45A. Synchronously with the printing, the tape feed motor 52 performs tape feed control through the drive circuit 53. In the event that printing data from an external computer, the data are input through the communication I/F 47 and serially stored into the editing input area 45B. Then, the data are stored as dot pattern data into the print buffer area 45A in accordance with the dot-pattern generation control program and are printed on the printing tape 36 through the thermal head.

With reference to FIG. 4, the following will now describe the error-elimination display data tables 61 to be stored in the error-elimination display data table storage area 43A of the ROM 43.

Referring to FIG. 4, the error-elimination display data tables 61 are configured of "Error cause" data, "Error-cause display data", and "Error-elimination display data". The "Error cause" represents the cause of an error attributed to an event that an input numbering character string cannot be serially incremented and printed through to the last print tape. The "Error-cause display data" is displayed on the LCD 7 in correspondence to the "Error cause", thereby indicating the "Error cause". The "Error-elimination display data" is displayed on the LCD 7 in correspondence to the "Error-cause display data", thereby indicating a way for eliminating the "error cause".

In the field of the "Error cause", the display data "Exceeding set length", "No tape cassette being loaded; No tape being loaded", and "Set number of print tapes is 0 or 100 or more" are pre-stored. "Exceeding set length" indicates that the present set length of the tape is a set length of the tape on which input numbering character strings cannot be printed through to the last one. "No tape cassette being loaded; No tape being loaded" indicates that the printing tape 36 does not remain or the tape cassette 21 is not mounted. "Set number of print tapes is 0 or 100 or more" indicates that the set number of print tapes is 0 or 100 or more.

Additional display data are pre-stored in the field of "Error-cause display data". For example, "Length error" is pre-stored corresponding to "Exceeding set length" under "Error cause", "No-tape error" is pre-stored corresponding to "No tape cassette being loaded; No tape being loaded" under "Error cause", and "Number-of- tape-labels error" is pre-stored corresponding to "Set number of print tapes is 0 or 100 or more" under "Error cause".

Further, in correspondence to "Length error" under "Error-cause display data", the display data "Change size, font, margin value, and set length" by way of an elimination way for the length error is pre-stored in the field of "Error-elimination display data". In correspondence to "No-tape error" under "Error-cause display data", the display data "Load tape" by way of an elimination way for the no-tape error is pre-stored in the field of "Error-elimination display data". In correspondence to "Number-of-print-tapes error" under "Error-cause display data", the display data "Change the number of print tapes" by way of an elimination way for the number-of-print-tapes error is pre-stored in the field of "Error-elimination display data".

With reference to FIGS. 5 to 13, the following will describe control processing for processes of the tape printer 1, such as the numbering setting process, which sets print-setting conditions for printing input numbering character strings, and the print process, which prints and outputs the numbering character strings.

Figure 5:
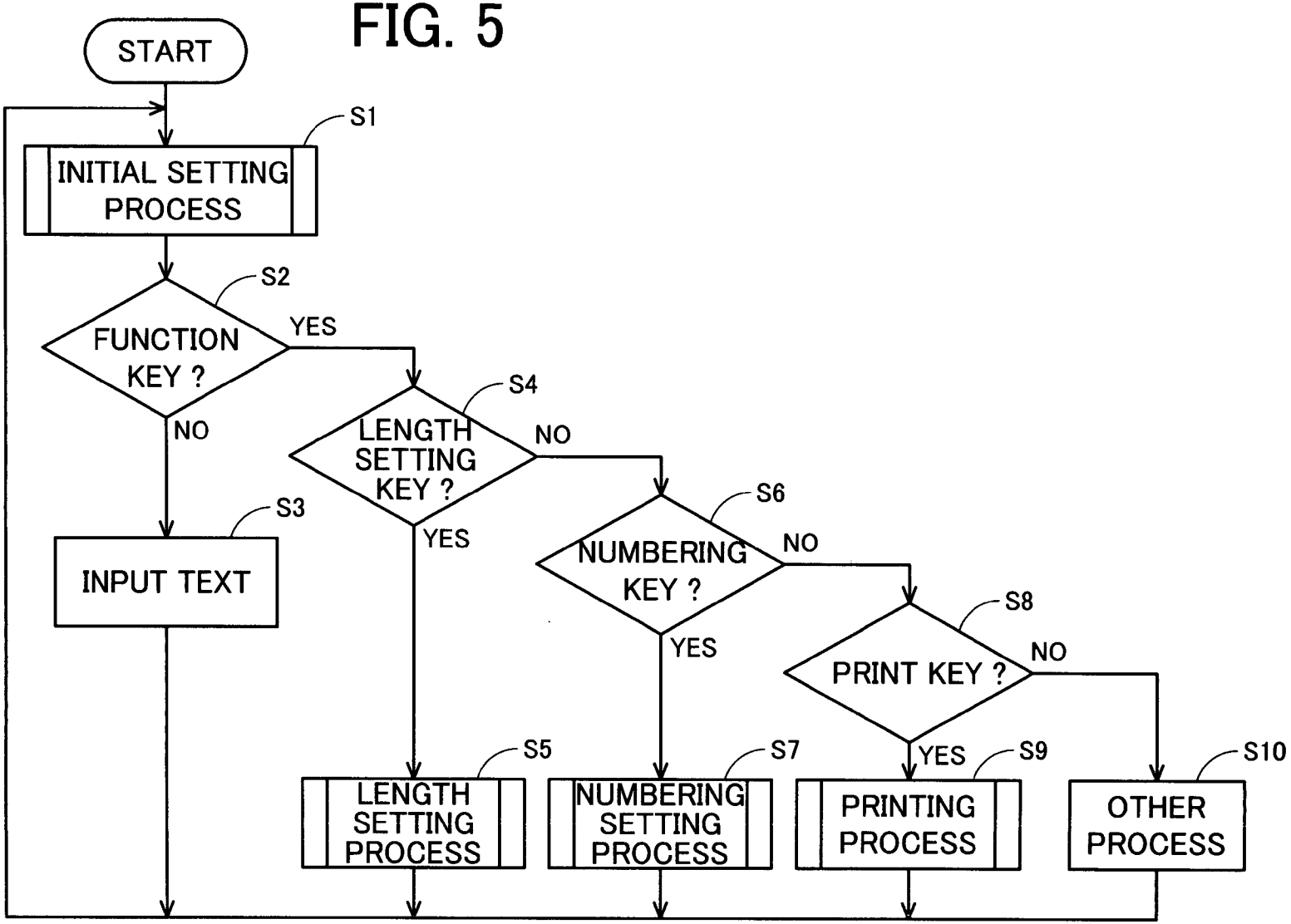
FIG. 5 is a main flow chart showing control processing for processes such as a text input process, a length setting process, and a numbering setting process of the tape printer according to the embodiment.

Referring to FIG. 5, at first in step ("S", hereafter) 1, the CPU 41 of the tape printer 1 executes a below-described initial setting process (see FIG. 6) at the time of activation.

In S2 the CPU 41 determines whether or not the function key 13A has been depressed.

Suppose the function key 13A has been undepressed, but character input keys 2 have been depressed (S2: NO). In this event, at S3, each time one of the character input keys 2 is depressed, the CPU 41 serially reads out characters registered in a "Normal" or "CAPS Lock" mode corresponding to the depressed each character input key 2 from the CGROM 42, performs blinking display (or black/white reversed video display) on the LCD 7, and displays text data thereon. Then, the CPU 41 again executes S2 and the subsequent processes. When the return key 4 is depressed, the processing performs normal display of the characters displayed in blinking display (or black/white reversed video display) on the LCD 7 whereby to perform verification display, and concurrently, stores the characters into the editing input area 45B as print character data (edited text). Thereafter, the processing again executes S2 and the subsequent processes.

If in S2 the function key 13A is determined to have been depressed (S2: YES), in S4 the CPU 41 determines whether or not the length set key 13B has been depressed.

If the length set key 13B has been depressed (S4: YES), in S5 the CPU 41 changes an initially set length of a print tape 22, which length has been read out from the ROM 43 and stored in the RAM 45, to an input tape length. Concurrently, the CPU 41 executes a below-described subprocess of the length setting process for the tape length stored in the RAM 45 (see FIG. 7), and again executes S2 and the subsequent processes.

If in S4 the length set key 13B is determined to have been undepressed (S4: NO), in S6 the CPU 41 determines whether or not the numbering key 13C has been depressed.

If in S6 the numbering key 13C is determined to have been depressed (S6: YES), in S7 the CPU 41 executes a below-described subprocess of the numbering setting process (see FIG. 8 or the like), and again executes S2 and the subsequent processes.

If in S6 the numbering key 13C is determined to have been undepressed (S6: NO), in S8 the CPU 41 determines whether or not the print key 3 has been depressed.

If the print key 3 is determined to have been depressed (S8: YES), in S9 the CPU 41 executes a below-described subprocess of the print process (see FIG. 13), and again executes S2 and the subsequent processes.

On the other hand, if in S8 the print key 3 is determined to have been undepressed (S8: NO), in S10, the CPU 41 executes various processes corresponding to depressed keys, and again executes S2 and the subsequent processes.

Figure 6:
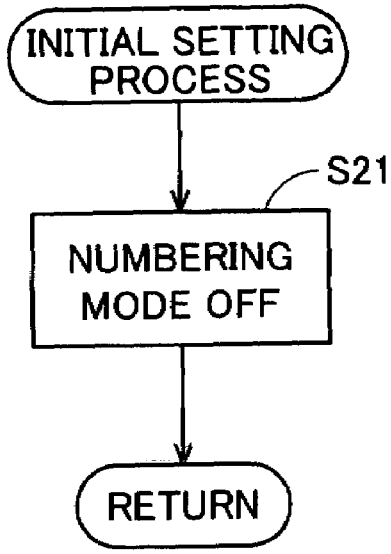
FIG. 6 is a sub-flow chart showing an initial setting process (initialization) of the tape printer according to the embodiment.

With reference to FIG. 6, the following will now describe the subprocess of the initial setting process being executed in S1.

As is shown in FIG. 6, in S21 the CPU 41 reads out a numbering flag from the RAM 45, substitutes "0" for the numbering flag, stores back the numbering flag into the RAM 45, terminates the subprocess, and returns the processing control to the routine of the main flow chart. Specifically, processing turns a numbering mode OFF thereby to return to the routine of the main flow chart.

Figure 7:
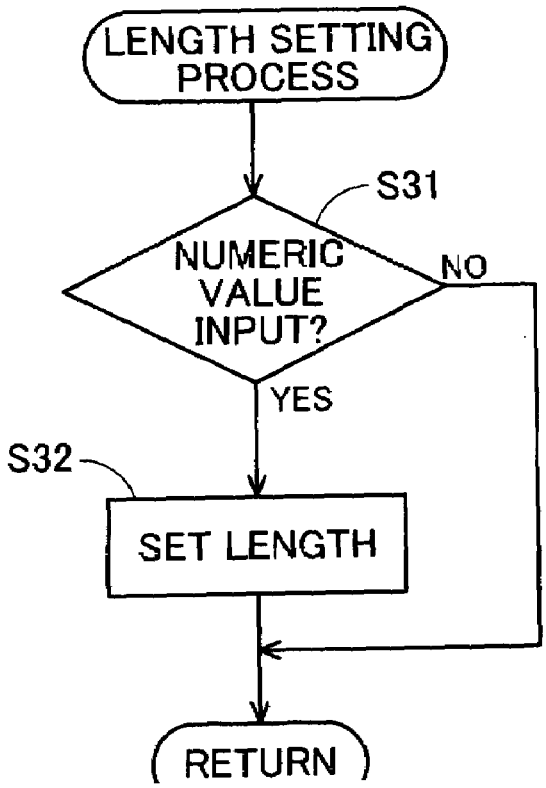
FIG. 7 is a sub-flow chart showing the length setting process of the tape printer according to the embodiment.

With reference to FIG. 7, the following will describe the subprocess of the length setting process, which is executed in S5.

As is shown in FIG. 7, first in S31 the CPU 41 displays "Length (mm)?" on the LCD 7 and performs blinking display (or black/white reversed video display) of a cursor (not shown) thereon. Thereafter, the CPU 41 determines whether a numeric value has been input through character input keys 2 of the keyboard 6.

If the numeric value has been input through character input keys 2 (S31: YES), in S32 the CPU 41 reads out from the RAM 45 a tape-length algebraic variable L as a tape length newly set with the input numeric value, substitutes the numeric value for the tape-length algebraic variable L, and stores back the set value into the RAM 45. The CPU 41 then terminates the subprocess and returns to the processing of the main flow chart.

At the activation, the CPU 41 reads out the initially set tape length (104 mm, for example) from the ROM 43, concurrently reads the tape-length algebraic variable L from the RAM 45, substitutes the initially set tape length for the tape-length algebraic variable L, and stores back the set value into the RAM 45.

On the other hand, if a numeric value has not been input through character input keys 2 (S31: NO), the CPU 41 terminates the subprocess and returns to the processing of the main flow chart.

With reference to FIGS. 8 to 12, the following will now describe the subprocess of the numbering setting process, which is executed in S7.

Figure 8:
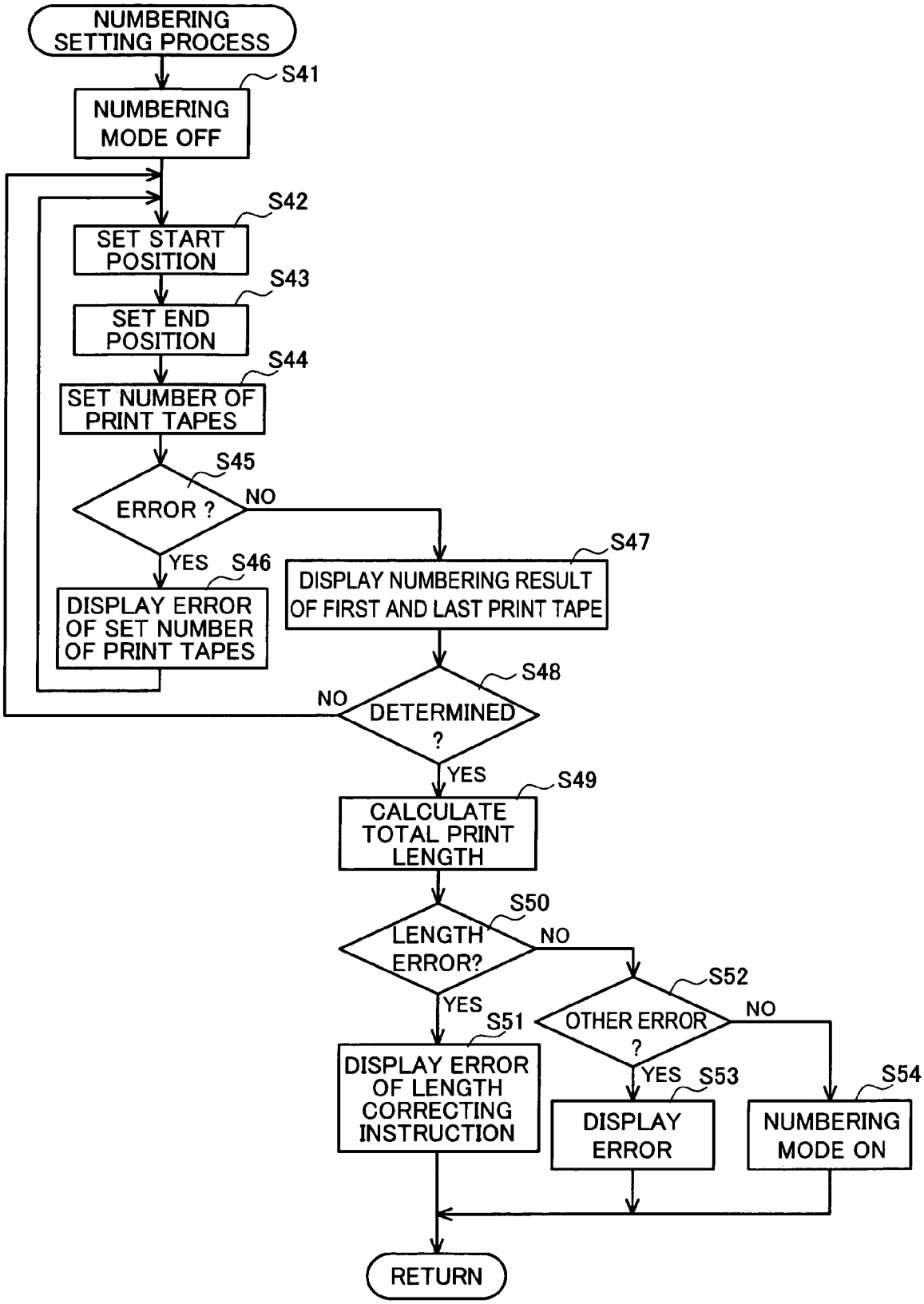
FIG. 8 is a sub-flow chart showing the numbering setting process of the tape printer according to the embodiment.

As is shown in FIG. 8, in S41 the CPU 41 reads out a numbering flag from the RAM 45, substitutes "0" for the numbering flag, and again stores the numbering flag in the RAM 45. Thereby, the numbering mode is turned OFF.

In S42, the CPU 41 controls the LCD 7 to provide a display inquiring about a start position of the numbering character string that is to be serially incremented (renewed). Then, when the cursor is moved through the operation of the cursor key 5 or the like, and the return key 4 is depressed, the CPU 41 stores into the RAM 45 a digit or alphabetic or Japanese syllabary character at the position to which the cursor has been moved as a start position that is to be serially incremented.

Figure 9A:
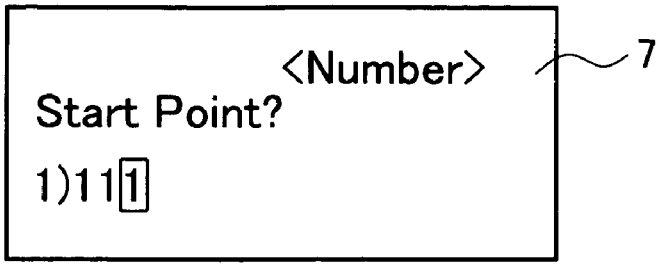
FIG. 9A shows an example screen display appearing on a liquid crystal display (LCD) of the tape printer according to the embodiment, the screen display being used to set a start position of numbering character string "111" being serially incremented.

An example of the above will be described herebelow. As is shown in FIG. 9A, when "111" is input as a numbering character string, the CPU 41 displays in an upper screen portion of the LCD 7 "<Number>" indicating that the input character string is a numbering character string. Concurrently, the CPU 41 controls "Start Point?", which inquires about the start position of the numbering character string that is to be serially incremented, to be displayed in a middle screen portion of the LCD 7. In addition, the CPU 41 controls the LCD 7 to display "1)" on a lower screen portion of the LCD 7. Subsequently, the CPU 41 displays the numbering character string "111", moves the cursor to the position of the first digit, and performs blinking display (or black/white reversed video display) on the LCD 7.

When the cursor is moved to the position of the righthand-end first digit and the return key 4 is depressed, the CPU 41 stores into the RAM 45 the righthand-end first digit as the start position for serial incrementation.

In S43, when the cursor is moved through the operation of the cursor key 5 or the like and the return key 4 is depressed, the CPU 41 stores the position in the RAM 45 as being an end position of the numbering character string. Thereafter, as below-described, the CPU 41 repeatedly increments numeric, alphabetic, or Japanese syllabary characters to the cursor-moved position and prints on the tape.

Figure 9B:
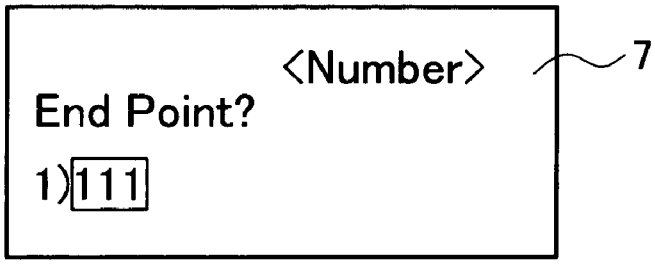
FIG. 9B shows an example image display to be used to set an end position of numbering character string "111" undergoing repetitious incrementation.

An example of the above will be described herebelow. As is shown in FIG. 9B, when "111" is input as a numbering character string, the CPU 41 displays in an upper screen portion of the LCD 7 "<Number>" indicating that input character string is a numbering character string. Concurrently, the CPU 41 displays in a middle screen portion of the LCD 7 "End Point?" inquiring about the end position of the numbering character string that is to be repeatedly incremented. In addition, the CPU 41 displays "1)" on a lower screen portion of the LCD 7. Subsequently, the CPU 41 moves the cursor to the position of the first digit falling at the start position of the numbering character string "111" that is to be serially incremented, and performs blinking display (or black/white reversed video display) of the character on the LCD 7.

When the cursor is moved from the position of the righthand-end first digit to the 100th digit, the CPU 41 performs blinking display (or black/white reversed video display) of the digits in the range of from the first to 100th positions. Then, when the return key 4 is depressed, the CPU 41 stores into the RAM 45 the left-end 100th digit as the end position of the numbering character string that is to be serially incremented.

Accordingly, in the above-described case, the numbering character string is repeatedly incremented as: "111"→"112"→ . . . →"998"→"999"→"000"→"001"→. . . .

In S44, the CPU 41 provides via the LCD 7 a display inquiring about the number of print tapes 22 on which the input numbering character strings are serially incremented and printed. When a numeric value is input via character input keys 2 and the return key 4 is depressed, the CPU 41 serially increments the input numeric value and stores into the RAM 45 the resultant value as data representing the number of print tapes 22.

Subsequently, in S45 the CPU 41 reads out the stored data representing the number of print tapes 22 from the RAM 45, and determines whether the number of print tapes 22 is "0" or "100" or more, that is, "number-of-print-tapes error".

In the tape printer 1, a maximum number of print tapes 22 on which a numbering character string can be serially incremented and printed is "99", and the value is pre-stored in the ROM 43.

When the number of print tapes 22 having been input through character input keys 2 is determined to be "0" or "100" or more (S45: NO), in S46 the CPU 41 serially increments the input numbering character string and specifies the "Error cause", with which the input numbering character string cannot be serially incremented and printed through to the last print tape 22, as being "Set number of print tapes is 0 or 100 or more". Then, the CPU 41 reads out "Number-of-print-tapes error" pre-stored as "Error-cause display data" corresponding to the "Error cause" from the error-elimination display data table 61 stored in the error-elimination display data table storage area 43A, and stores the read-out display data into the display image buffer 45C. Then, the LCD 7 displays the "Number-of-print-tapes error" in the form of an error-cause display indicating that the currently set number of print tapes is a number of print tapes on which numbering character strings cannot be printed through to the last one. Then, the CPU 41 reads out from the table 61 "Change the number of print tapes" pre-stored as "Error-elimination display data" corresponding to the "Error cause" and stores it into the display image buffer 45C. Then, the LCD 7 displays the "Change the number of print tapes" as being the error elimination display for eliminating the error cause. Thereafter, the CPU 41 again executes S42 and the subsequent processes.

Figure 10:
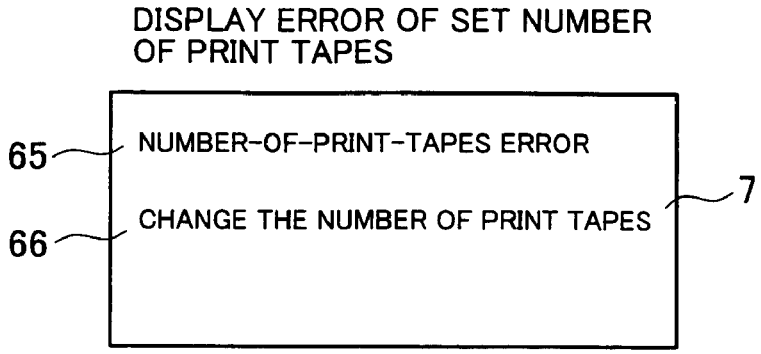
FIG. 10 shows example screen displays "Error-cause display" and "Error elimination display" appearing on the LCD in the event that "Error cause" is specified as being "Set number of print tapes is 0 or 100 or more", the error being attributed to an event that a numbering character string having been input to the tape printer according to the embodiment cannot be serially incremented and printed through to a last print tape.

For example, as is shown in FIG. 10, "Number-of-print-tapes error" is displayed as being an error-cause display 65 in an upper screen portion of the LCD 7. In addition, "Change the number of print tapes" is displayed as being an error elimination display 66 in a middle screen portion of the LCD 7.

In accordance with the "Number-of-print-tapes error" information on the error-cause display 65, a user can easily verify that the error cause is attributed to the event that the numbering character string cannot be serially incremented and printed through to the last print tape 22. In addition, with the "Change the number of print tapes" information on the error elimination display 66, the user can easily verify that the error cause can be eliminated by changing the set number of print tapes.

On the other hand, if in S45 the number of print tapes having been input through character input keys 2 is determined to be a printable number of print tapes, that is, within the range between "1" or more and "99" or less (S45: YES), in S47 the CPU 41 displays on the LCD 7 the numbering character string to be printed on the first print tape 22 and the numbering character string to be printed on the last print tape 22.

Figure 9C:
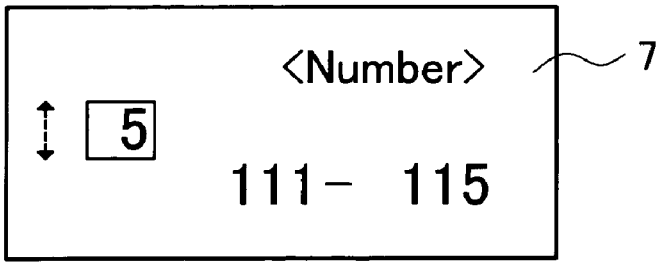
FIG. 9C shows an example image display to be used to set the number of print tapes on which numbering character strings are serially incremented are printed.

For example, as is shown in FIG. 9C, the CPU 41 displays in an upper screen portion of the LCD 7 "<Number>" indicating that the input character string is a numbering character string. In addition, the CPU 41 displays in a middle screen portion of the LCD 7 "5" indicating the number of print tapes 22 having been input through character input keys 2. When the return key 4 is depressed, the CPU 41 displays on a lower screen portion of the LCD 7 the numbering character string "111" that is to be printed on the first print tape 22, subsequently displays "–" indicating a range, and further displays the numbering character string "115" that is to be printed on the last print tape 22.

The above enables the user to easily recognize that the numbering character strings ranging from "111" to "115" will be serially incremented and printed on five print tapes 22.

Subsequently, in S48 the CPU 41 determines whether or not the numbering character strings ranging from "111" to "115" have been determined to be serially incremented and printed on five print tapes 22. In the determination process, when the return key 4 is depressed within a predetermined time, the CPU 41 determines that the numbering character strings ranging from "111" to "115" have been determined to be serially incremented and printed on five print tapes 22.

If the return key 4 has not been depressed within the predetermined time (S48: NO), the CPU 41 again executes S42 and the subsequent processes.

On the other hand, if the return key 4 has been depressed within the predetermined time (S48: YES), in S49 when serially incrementing and printing the numbering character strings through to the last print tape 22, the CPU 41 calculates print lengths individually necessary for one print tape 22 and stores the calculated data into the RAM 45.

The calculation of the print length necessary for one print tape 22 is carried out by calculating a total value of margin lengths in individual front and rear end portions and the overall length of the numbering character string that is to be printed on each print tape 22. For example, in the case of a numbering character string (such as "111") formed of three digits in which the character width is 18 mm and the character pitch is 1 mm, the overall length of the numbering character string is calculated as: 18 mm×3+1 mm×2=56 mm. When the front and rear end margin lengths are each 24 mm, the print length necessary for one print tape 22 is calculated as: 24 mm+56 mm +24 mm=104 mm.

Subsequently, in S50 the CPU 41 reads out from the RAM 45 a tape-length algebraic variable L, and determines whether each of the calculated print lengths necessary for one print tape 22 is less than or equal to the tape-length algebraic variable L. That is, the CPU 41 determines whether the numbering character string can be serially incremented and printed through to the last print tape 22.

If any one of the calculated print lengths necessary for one print tape 22 is determined greater than the tape-length algebraic variable L (S50: YES), in S51 the CPU 41 specifies "Error cause", with which input numbering character string cannot be serially incremented and printed through to the last print tape 22, as being "Exceeding set length". Then, the CPU 41 reads out "Length error" pre-stored as "Error-cause display data" corresponding to the "Error cause" from the error-elimination display data table 61 stored in the error-elimination display data table storage area 43A, and stores the read-out display data into the display image buffer 45C. Then, the LCD 7 displays the "Length error" in the form of an error-cause display indicating that the currently set tape length is a tape length on which the numbering character string cannot be serially incremented and printed through to the last print tape 22. Then, the CPU 41 reads out from the table 61 "Change size, font, margin value, and defined length" pre-stored as "Error-elimination display data" corresponding to the "Error cause" and stores it into the display image buffer 45C. Then, the LCD 7 displays the "Change size, font, margin value, and defined length" as being the error elimination display for eliminating the error cause. Thereafter, the CPU 41 terminates the subprocess and returns to the processing of the main flow chart.

Figure 11:
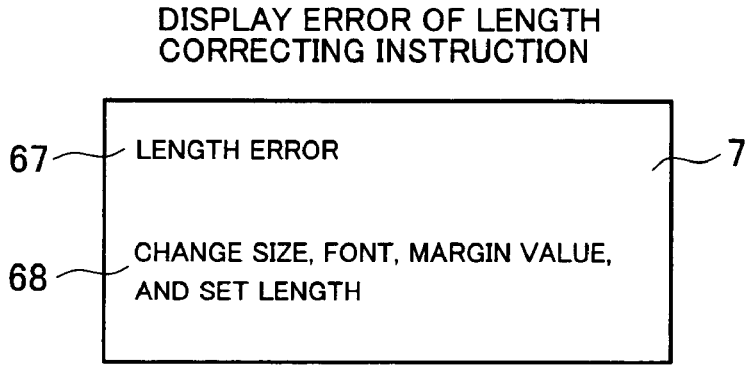
FIG. 11 shows example screen displays "Error-cause display" and "Error elimination display" appearing on the LCD in the event that "Error cause" is specified as being "Exceeding set length", the error being attributed to an event that a numbering character string having been input to the tape printer according to the embodiment cannot be serially incremented and printed through to the last print tape.

For example, as is shown in FIG. 11, "Length error" is displayed as being an error-cause display 67 in an upper screen portion of the LCD 7. In addition, "Change size, font, margin value, and defined length" is displayed as being an error elimination display 68 in a middle screen portion and a lower screen portion of the LCD 7. Thereafter, the CPU 41 terminates the subprocess and returns to the processing of the main flow chart.

In accordance with the "Length error" on the error-cause display 67, the user can easily verify that the error cause is attributed to the event that the numbering character string cannot be serially incremented and printed through to the last print tape 22. In addition, with the "Change size, font, margin value, and defined length" information on the error elimination display 68, the user can easily recognize that the error cause can be eliminated by changing the size, font, margin value, and defined length".

On the other hand, if in S50 any one of the calculated print lengths necessary for one print tape 22 is determined less than or equal to the tape-length algebraic variable L (S50: NO), in S52 the CPU 41 determines whether an other error cause attributed to the event that the numbering character string cannot be serially incremented and printed through to the last print tape 22.

If an other error cause is detected to be present (S52: YES), in S53 the CPU 41 specifies the error cause, reads out "Error-cause display data" corresponding to the "Error cause" from the error-elimination display data table 61 stored in the error-elimination display data table storage area 43A, and stores the read-out display data into the display image buffer 45C. Then the LCD 7 displays the "Error-cause display data" as being the error cause display. In addition, the CPU 41 reads out "Error-elimination display data" corresponding to the "Error cause" and stores the read-out display data into the display image buffer 45C. Then, the LCD 7 displays the "Error-elimination display data" as being the error elimination display for eliminating the error cause. Thereafter, the CPU 41 terminates the subprocess and returns to the processing of the main flow chart.

Figure 12:
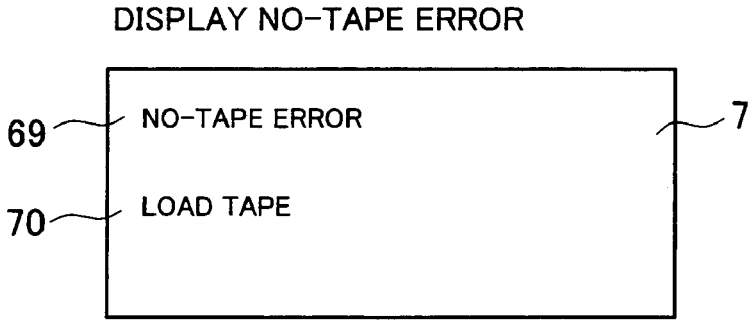
FIG. 12 shows example screen displays "Error-cause display" and "Error elimination display" appearing on the LCD in the event that "Error cause" is specified as being "No tape cassette being loaded; No tape being loaded", the error being attributed to an event that the numbering character string having been input to the tape printer according to the embodiment cannot be serially incremented and printed through to the last print tape.

For example, as is shown in FIG. 12, if the other error cause is determined to attribute to an event that the tape cassette 21 is not loaded into the cassette housing part 8 or the printing tape 36 is withdrawn to the last one, the CPU 41 specifies the "Error cause", with which input numbering character string cannot be serially incremented and printed through to the last print tape 22, as being "No tape cassette being loaded; No tape being loaded". Then, the CPU 41 reads out "No-tape error" stored as "Error-cause display data" corresponding to the "Error cause" from the error-elimination display data table 61 stored in the error-elimination display data table storage area 43A, and stores the read-out display data into the display image buffer 45C. In addition, the CPU 41 reads out "Load tape" stored as "Error-elimination display data" corresponding to the "Error cause" from the table 61 and stores the read-out display data into the display image buffer 45C. Then, the CPU 41 displays the "No-tape error" in the form of an error-cause display 69 in an upper screen portion of the LCD 7. Concurrently, the LCD 7 displays "Load tape" in the form of an error-elimination display 70 in a middle screen portion thereof. Thereafter, the CPU 41 terminates the subprocess and returns to the processing of the main flow chart.

In accordance with the "No-tape error" on the error-cause display 69, the user can easily verify that the error cause is attributed to the event that, for example, the tape cassette 21 is not loaded into the cassette housing part 8 or the printing tape 36 is withdrawn to the last one. Further, with the "Load tape" information on the error elimination display 70, the user can easily recognize that the error cause can be eliminated by loading a new tape cassette 21 into the cassette housing part 8.

On the other hand, if in S52 no other error cause is determined to be present (S52: NO), in S54 the CPU 41 reads out a numbering flag from the RAM 45, substitutes "1" for the numbering flag, and stores it into the RAM 45. Thereafter, the CPU 41 terminates the subprocess, and returns to the processing of the main flow chart. That is, the numbering mode is turned ON, and control is returned to the routine to the main flow chart.

Figure 13:
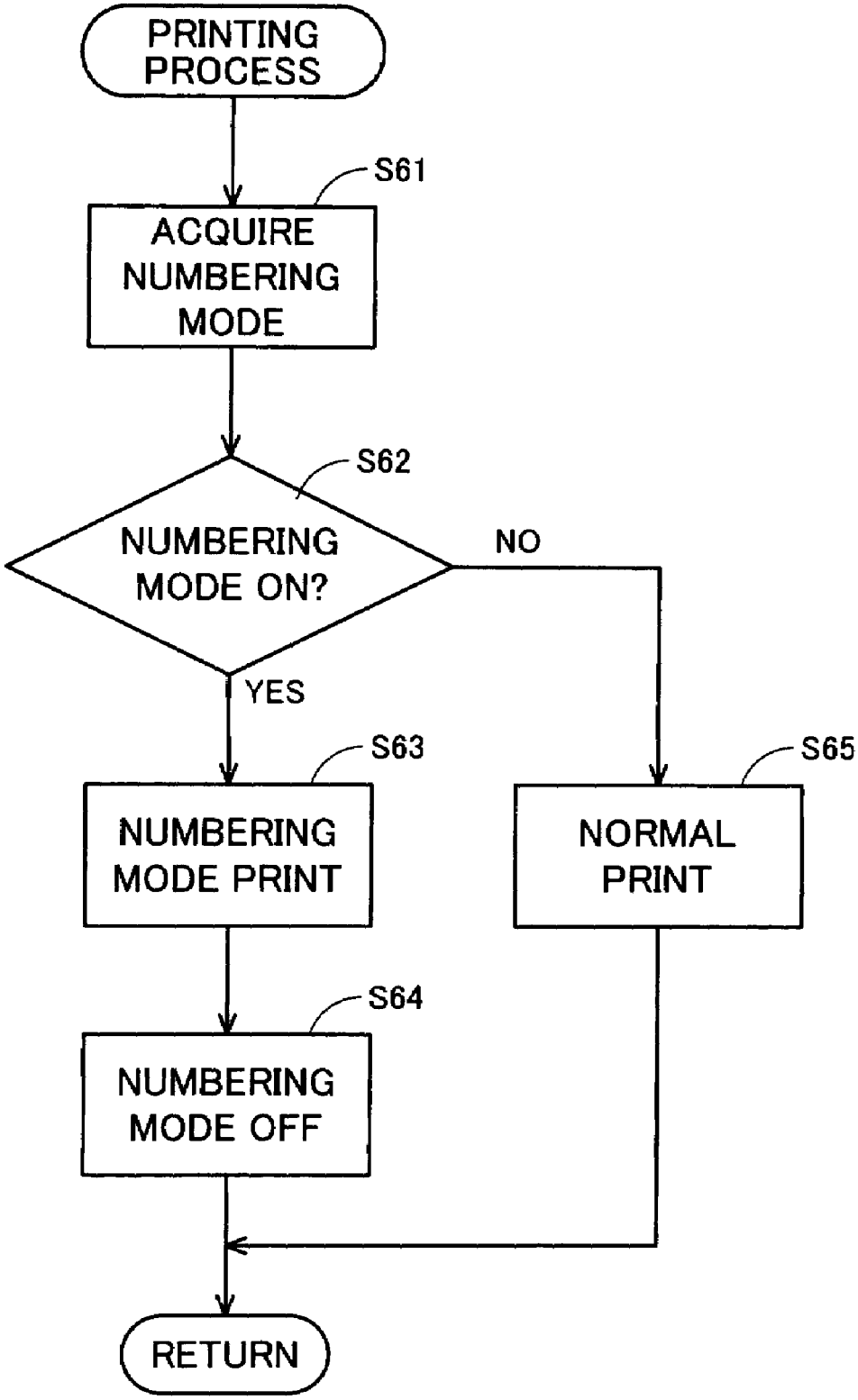
FIG. 13 is a sub-flow chart showing the print process of the tape printer according to the embodiment.

With reference to FIG. 13, the following will now describe the subprocess of the print process, which is executed in S9.

As is shown in FIG. 13, in S61 the CPU 41 reads out a numbering flag from the RAM 45.

In S62 the CPU 41 determines whether or not a print mode (numbering mode) for serially incrementing and printing the numbering character string in units of the print tape 22 is set. That is, the CPU 41 determines whether or not the numbering mode is ON or OFF. In the determination of whether the numbering mode is ON or OFF, the CPU 41 determines the numbering mode is ON when the numbering flag having been read out in S61 is "1", and the CPU 41 determines the numbering mode is OFF when this numbering flag is "0".

Subsequently, in S62 when having determined that the numbering mode is ON (S62: YES), in S63 the CPU 41 serially increments the numbering character string having been set in the numbering setting process (S7) and prints incremented numbering character strings on set number of print tapes.

In S64 the CPU 41 reads out the numbering flag from the RAM 45, substitutes "0" for the numbering flag, and stores back the numbering flag into the RAM 45. Thereafter, the CPU 41 terminates the subprocess and returns to the processing of the main flow chart; that is, the CPU 41 turns OFF the numbering mode, and returns to the processing of the main flow chart.

On the other hand, in S62 if the CPU 41 determines that the numbering mode is OFF (S62: NO), the CPU 41 prints print output data stored in the print buffer 43A on the printing tape 36 thereby to make a print tape 22 of the predetermined length. Thereafter, CPU 41 terminates the subprocess and returns to the processing of the main flow chart.

In summary, according to the tape printer 1 of the present embodiment, after a numbering character string is input, the start position of the numbering character string to be serially incremented and the end position of the numbering character string to be repeatedly incremented and printed on a print tape 22 are set (S41 to S43), and the number of the print tapes 22 on which the input numbering character string is serially incremented and printed is set. In this case, a numbering character string to be printed on a first print tape 22 and a numbering character string to be printed on a last print tape 22 are displayed on the LCD 7 (S44 and S45(NO) to S47). Thereby, before the start of printing of the character strings, a user can verify the numbering character strings that are to be printed on the first print tape 22 and on the last print tape 22. This consequently enables securely preventing an excess or shortage of the number of the print tape 22 on which the numbering character strings are printed.

Further, when the input numbering character string cannot be serially incremented and printed in units of the print tape 22, error-cause displays (such as, "Length error", "No-tape error", and "Number-of-print-tapes error") corresponding to the respective error causes (such as "Exceeding set length", "No tape cassette being loaded; No tape being loaded", and "Set number of print tapes is 0 or 100 or more") disabling printing through to the last print tape 22 are presented before the start of printing. Concurrently, there are presented error elimination displays (such as "Change size, font, margin value, and defined length", "Load tape", and "Change the number of print tapes") indicating ways for eliminating the error causes. Accordingly, the user can know the error causes disabling printing through to the last print tape 22 and can easily and quickly know the ways for eliminating the error causes before the start of printing. Consequently, the error causes can be quickly eliminated, and the input numbering character strings can be securely printed through to the last print tape 22.

In addition, when the error cause display 65 is "Number-of-print-tapes error" and the error elimination display 66 is "Change the number of print tapes", the user can easily and quickly eliminate the "Number-of-print-tapes error" by resetting the number of print tapes 22 (S45(YES)→S42 to S44).

Further, when the error-cause display 67 is "Length error" and the error elimination display 66 is "Change size, font, margin value, and defined length", the user can easily and quickly eliminate the "Length error" by changing the set length through, for example, the length setting process (S5) (S49 to S51).

Further, when the error-cause display 69 is "No-tape error" and the error elimination display 70 is "Load tape", the user can easily and quickly eliminate the "No-tape error" by loading a new tape cassette 21 into the cassette housing part 8 (S52 to S53).

The present invention is not limited by the embodiment described above, and various changes and modification may of course be made without departing from the spirit of scope of the invention.

What is claimed is:

1. A tape printer comprising: a tape feeding mechanism that feeds a long tape; an input device; a display device that displays printing data composed of characters, graphics, and/or the like input or edited by the input device; a printing mechanism that prints the printing data on the tape; and a control circuit that performs driving control of the printing mechanism, wherein the tape printer serially increments and prints a numbering character string having a predetermined arrangement sequential order, such as a numerical, alphabetical, or Japanese syllabary order, in units of a print tape by using the printing mechanism, wherein the control circuit comprises a processor that executes:

a start-position setting process for specifying a firstly incrementing character of a numbering character string input by the input device;

an end-position setting process for specifying a maximum number of repeatedly incrementable characters or maximum number of repeatedly incrementable digits of the numbering character string;

a number-of-print-tapes setting process for specifying a number of print tapes on which the numbering character string is to be serially incremented and printed; and a numbering-result displaying process for displaying on the display device a numbering character string that is to be printed on a first print tape and a numbering character string that is to be printed on a last print tape.

2. The tape printer according to claim 1, wherein the processor further executes:

a determination process for determining before the start of printing whether or not a numbering character string input with a condition specified by at least one of the start-position setting process, the end-position setting process, and the number-of-print-tapes setting process can be serially incremented in units of the print tape and printed through to the last print tape; and an error display process for displaying on the display device, before the start of printing, an error display indicating that the numbering character string cannot be printed through to the last print tape when it is determined that the numbering character string input with the condition is unable to be serially implemented in units of the print tape and printed through to the last print tape.

3. The tape printer according to claim 2, wherein the control circuit comprises an error-cause display storage section that stores a plurality of error-cause displays individually indicating error causes with which the numbering character string input with the condition cannot be serially incremented in units of the print tape and printed through to the last print tape, and the processor further executes:

an error-cause determination process for determining the error cause with which the numbering character string input with the condition cannot be serially incremented in units of the print tape and printed through to the last print tape; and an error-cause display process for displaying on the display device the error cause display corresponding to the error cause determined by the error-cause determination process, when displaying the error display before the start of printing.

4. The tape printer according to claim 3, wherein the control circuit comprises an error-elimination display storage section that stores error-elimination displays indicating ways for eliminating the individual error causes, and the processor further executes an error-elimination display process for displaying on the display device the error elimination display corresponding to the error-cause display when displaying the error-cause display on the display device.

5. The tape printer according to claim 4, wherein the individual error causes include a cause for a number-of-print-tapes error occurring in an event that the number of print tapes specified in the number-of-print-tapes setting process is an unprintable number of print tapes.

6. The tape printer according to claim 5, wherein the control circuit further comprises a tape-length storage section that pre-stores an initially set tape length of the print tape on which the numbering character string is to be printed;

the processor further executes a length setting process capable of changing the initially set tape length, which is to be stored in the tape-length storage section, to a new tape length; and the individual error causes include a cause for a length error occurring in an event that the tape length to be stored in the tape-length storage section is a length on which the numbering character string cannot be printed.

7. The tape printer according to claim 3, wherein the individual error causes include a cause for a number-of-print-tapes error occurring in an event that the number of print tapes specified in the number-of-print-tapes setting process is an unprintable number of print tapes.

8. The tape printer according to claim 7, wherein the control circuit further comprises a tape-length storage section that pre-stores an initially set tape length of the print tape on which the numbering character string is to be printed;

the processor further executes a length setting process capable of changing the initially set tape length, which is to be stored into the tape-length storage section, to a new tape length; and the individual error causes include a cause for a length error occurring in an event that the tape length to be stored in the tape-length storage section is a length on which the numbering character string cannot be printed.

9. The tape printer according to claim 3, wherein the control circuit further comprises a tape-length storage section that pre-stores an initially set tape length of the print tape on which the numbering character string is to be printed;

the processor further executes a length setting process capable of changing the initially set tape length, which is to be stored into the tape-length storage section, to a new tape length; and the individual error causes include a cause for a length error occurring in an event that the tape length to be stored in the tape-length storage section is a length on which the numbering character string cannot be printed.

10. The tape printer according to claim 4, wherein the control circuit further comprises a tape-length storage section that pre-stores an initially set tape length of the print tape on which the numbering character string is to be printed;

the processor further executes a length setting process capable of changing the initially set tape length, which is to be stored into the tape-length storage section, to a new tape length; and the individual error causes include a cause for a length error occurring in an event that the tape length to be stored in the tape-length storage section is a length on which the numbering character string cannot be printed.

11. A tape printer comprising: a tape feeding mechanism that feeds a long tape; an input device; a display device that displays printing data composed of characters, graphics, and/or the like input or edited by the input device; and a printing mechanism that prints the printing data on the tape;

a control circuit that performs driving control of the printing mechanism, wherein the tape printer serially increments and prints a numbering character string having a predetermined arrangement sequential order, such as a numerical, alphabetical, or Japanese syllabary order, in units of a print tape by using the printing mechanism, wherein the control circuit comprises:

an error-cause display storage section that stores a plurality of error-cause displays individually indicating error causes with which the numbering character string input with the input device cannot be serially incremented in units of the print tape and printed through to the last print tape;

an error-elimination display storage section that stores error-elimination displays indicating ways for eliminating the individual error causes; and a processor that executes:

a start-position setting process for specifying a firstly incrementing character of the numbering character string input by the input device;

an end-position setting process for specifying a maximum number of repeatedly incrementable characters or maximum number of repeatedly incrementable digits of the numbering character string;

a number-of-print-tapes setting process for specifying a number of print tapes on which the numbering character string is to be serially incremented and printed;

a numbering-result displaying process for displaying on the display device a numbering character string that is to be printed on a first print tape and a numbering character string that is to be printed on a last print tape;

a determination process for determining before the start of printing whether or not a numbering character string input with a condition specified by at least one of the start-position setting process, the end-position setting process, and the number-of-print-tapes setting process can be serially incremented in units of the print tape and printed through to the last print tape;

an error-cause determination process for determining the error cause with which the numbering character string input with the condition cannot be serially incremented in units of the print tape and printed through to the last print tape;

an error display process for displaying on the display device, before the start of printing, an error display indicating that the numbering character string cannot be printed through to the last print tape when it is determined that the numbering character string input with the condition is unable to be serially incremented in units of the print tape and printed through to the last print tape;

an error-cause display process for displaying on the display device the error cause display corresponding to the error cause determined by the error-cause determination process; and an error-elimination display process for displaying on the display device the error elimination display corresponding to the error-cause display.

12. A tape printer comprising: a tape feeding mechanism that feeds a long tape; an input device; a display device that displays printing data composed of characters, graphics, and/or the like input or edited by the input device; and a printing mechanism that prints the printing data on the tape; a control circuit that performs driving control of the printing mechanism, wherein the tape printer serially increments and prints a numbering character string having a predetermined arrangement sequential order, such as a numerical, alphabetical, or Japanese syllabary order, in units of a print tape by using the printing mechanism, wherein the control circuit comprises:

an error-cause display storage section that stores a plurality of error-cause displays individually indicating error causes with which the numbering character string input with the input device cannot be serially incremented in units of the print tape and printed through to the last print tape;

an error-elimination display storage section that stores error-elimination displays indicating ways for eliminating the individual error causes; and a processor that executes:

a start-position setting process for specifying a firstly incrementing character of a numbering character string input by the input device;

an end-position setting process for specifying a maximum number of repeatedly incrementable characters or maximum number of repeatedly incrementable digits of the numbering character string;

a number-of-print-tapes setting process for specifying a number of print tapes on which the numbering character string is to be serially incremented and printed;

a numbering-result displaying process for displaying on the display device a numbering character string that is to be printed on a first print tape and a numbering character string that is to be printed on a last print tape;

a determination process for determining before the start of printing whether or not a numbering character string input with a condition specified by at least one of the start-position setting process, the end-position setting process, and the number-of-print-tapes setting process can be serially incremented in units of the print tape and printed through to a last print tape;

an error-cause determination process for determining the error cause with which the numbering character string input with the condition cannot be serially incremented in units of the print tape and printed through to the last print tape;

an error display process for displaying on the display device, before the start of printing, an error display indicating that the numbering character string cannot be printed through to the last print tape when it is determined that the numbering character string input with the condition is unable to be serially incremented in units of the print tape and printed through to the last print tape;

an error-cause display process for displaying on the display device the error cause display corresponding to the error cause determined by the error-cause determination process; and an error-elimination display process for displaying on the display device the error elimination display corresponding to the error-cause display, and the individual error causes include a cause for a number-of-print-tapes error occurring in an even that the number of print tapes specified in the number-of-print-tapes setting process is an unprintable number of print tapes.

13. A tape printer comprising: a tape feeding mechanism that feeds a long tape; an input device; a display device that displays printing data composed of characters, graphics, and/or the like input or edited by the input device; and a printing mechanism that prints the printing data on the tape; a control circuit that performs driving control of the printing mechanism, wherein the tape printer serially increments and prints a numbering character string having a predetermined arrangement sequential order, such as a numerical, alphabetical, or Japanese syllabary order, in units of a print tape by using the printing mechanism, wherein the control circuit comprises:

an error-cause display storage section that stores a plurality of error-cause displays individually indicating error causes with which the numbering character string input with the input device cannot be serially incremented in units of the print tape and printed through to the last print tape;

an error-elimination display storage section that stores error-elimination displays indicating ways for eliminating the individual error causes;

a tape-length storage section that pre-stores an initially set tape length of the print tape on which the numbering character string is to be printed; and a processor that executes:

a start-position setting process for specifying a firstly incrementing character of a numbering character string input by the input device;

an end-position setting process for specifying a maximum number of repeatedly incrementable characters or maximum number of repeatedly incrementable digits of the numbering character string;

a number-of-print-tapes setting process for specifying a number of print tapes on which the numbering character string is to be serially incremented and printed;

a numbering-result displaying process for displaying on the display device a numbering character string that is to be printed on a first print tape and a numbering character string that is to be printed on a last print tape;

a determination process for determining before the start of printing whether or not a numbering character string input with a condition specified by at least one of the start-position setting process, the end-position setting process, and the number-of-print-tapes setting process can be serially incremented in units of the print tape and printed through to a last print tape;

an error-cause determination process for determining the error cause with which the numbering character string input with the condition cannot be serially incremented in units of the print tape and printed through to the last print tape;

an error display process for displaying on the display device, before the start of printing, an error display indicating that the numbering character string cannot be printed through to the last print tape when it is determined that the numbering character string input with the condition is unable to be serially incremented in units of the print tape and printed through to the last print tape;

an error-cause display process for displaying on the display device the error cause display corresponding to the error cause determined by the error-cause determination process;

an error-elimination display process for displaying on the display device the error elimination display corresponding to the error-cause display; and a length setting process capable of changing the initially set tape length, which is to be stored into the tape-length storage section, to a new tape length;

the individual error causes include a cause for a number-of-print-tapes error occurring in an event that the number of print tapes specified in the number-of-print-tapes setting process is an unprintable number of print tapes; and a cause for a length error occurring in an event that the tape length to be stored in the tape-length storage section is a length on which the numbering character string cannot be printed.

14. A tape making method for serially incrementing and printing a numbering character string having a predetermined arrangement sequential order, such as a numerical, alphabetical, or Japanese syllabary order, in units of a print tape by using a tape printer that comprises a tape feeding mechanism that feeds a long tape; an input device; a display device that displays printing data composed of characters, graphics, and/or the like input or edited by the input device; a printing mechanism that prints the printing data on the tape; and a control circuit that performs drive control of the printing mechanism, the tape making method comprising:

a start-position setting step of specifying a firstly incrementing character of a numbering character string input by the input device;

an end-position setting step of specifying a maximum number of repeatedly incrementable characters or maximum number of repeatedly incrementable digits of the numbering character string;

a number-of-print-tapes setting step of specifying a number of print tapes on which the numbering character string is to be serially incremented and printed; and a numbering-result displaying step of displaying on the display device a numbering character string that is to be printed on a first print tape and a numbering character string that is to be printed on a last print tape.

15. The tape making method according to claim 14, further comprising:

a determination step of determining before the start of printing whether or not a numbering character string input with a condition specified by at least one of the start-position setting step, the end-position setting step, and the number-of-print-tapes setting step can be serially incremented in units of the print tape and printed through to a last print tape; and an error display step of displaying on the display device, before the start of printing, an error display indicating that the numbering character string cannot be printed through to the last print tape when it is determined that the numbering character string input with the condition is unable to be serially incremented in units of the print tape and printed through to the last print tape.

16. The tape making method according to claim 15, wherein the control circuit comprises an error-cause display storage section that stores a plurality of error-cause displays individually indicating error causes with which the numbering character string input with the condition cannot be serially incremented in units of the print tape and printed through to the last print tape, and the tape making method further comprises:

an error-cause determination steps of determining the error cause with which the numbering character string input with the condition cannot be serially incremented in units of the print tape and printed through to the last print tape; and an error-cause display steps of displaying on the display device the error cause display corresponding to the error cause determined by the error-cause determination step, when displaying the error display before the start of printing.

17. The tape making method according to claim 16, wherein:

the control circuit comprises an error-elimination display storage section that stores error-elimination displays indicating ways for eliminating the individual error causes; and the method further comprises an error-elimination display step of displaying on the display device the error elimination display corresponding to the error-cause display when displaying the error-cause display on the display device.

18. The tape making method according to claim 17, wherein the individual error causes include a cause for a number-of-print-tapes error occurring in an event that the number of print tapes specified in the number-of-print-tapes setting step is an unprintable number of print tapes.

19. The tape making method according to claim 18, wherein the control circuit further comprises a tape-length storage section that pre-stores an initially set tape length of the print tape on which the numbering character string is to be printed;

the method further comprises a length setting step capable of changing the initially set tape length, which is to be stored into the tape-length storage section, to a new tape length; and the individual error causes include a cause for a length error occurring in an event that the tape length to be stored in the tape-length storage section is a length on which the numbering character string cannot be printed.

20. The tape making method according to claim 16, wherein the individual error causes include a cause for a number-of-print-tapes error occurring in an event that the number of print tapes specified in the number-of-print-tapes setting step is an unprintable number of print tapes.

21. The tape making method according to claim 20, wherein the control circuit further comprises a tape-length storage section that pre-stores an initially set tape length of the print tape on which the numbering character string is to be printed;

the method further comprises a length setting step capable of changing the initially set tape length, which is to be stored into the tape-length storage section, to a new tape length; and the individual error causes include a cause for a length error occurring in an event that the tape length to be stored in the tape-length storage section is a length on which the numbering character string cannot be printed.

22. The tape making method according to claim 16, wherein the control circuit further comprises a tape-length storage section that pre-stores an initially set tape length of the print tape on which the numbering character string is to be printed;

the method further comprises a length setting step capable of changing the initially set tape length, which is to be stored into the tape-length storage section, to a new tape length; and the individual error causes include a cause for a length error occurring in an event that the tape length to be stored in the tape-length storage section is a length on which the numbering character string cannot be printed.

23. The tape making method according to claim 17, wherein the control circuit further comprises a tape-length storage section that pre-stores an initially set tape length of the print tape on which the numbering character string is to be printed;

the method further comprises a length setting step capable of changing the initially set tape length, which is to be stored into the tape-length storage section, to a new tape length; and the individual error causes include a cause for a length error occurring in an event that the tape length to be stored in the tape-length storage section is a length on which the numbering character string cannot be printed.

24. A tape making method for serially incrementing and printing a numbering character string having a predetermined arrangement sequential order, such as a numerical, alphabetical, or Japanese syllabary order, in units of a print tape by using a tape printer that comprises a tape feeding mechanism that feeds a long tape; an input device; a display device that displays printing data composed of characters, graphics, and/or the like input or edited by the input device; a printing mechanism that prints the printing data on the tape; and a control circuit that performs drive control of the printing mechanism, wherein the control circuit comprises:

an error-cause display storage section that stores a plurality of error-cause displays individually indicating error causes with which the numbering character string input by the input device cannot be serially incremented in units of the print tape and printed through to the last print tape; and an error-elimination display storage section that stores error-elimination displays indicating ways for eliminating the individual error causes, the method further comprises:

a start-position setting step of specifying a firstly incrementing character of a numbering character string input by the input device;

an end-position setting step of specifying a maximum number of repeatedly incrementable characters or maximum number of repeatedly incrementable digits of the numbering character string;

a number-of-print-tapes setting step of specifying a number of print tapes on which the numbering character string is to be serially incremented and printed;

a numbering-result displaying step of displaying on the display device a numbering character string that is to be printed on a first print tape and a numbering character string that is to be printed on a last print tape;

a determination step of determining before the start of printing whether or not a numbering character string input with a condition specified by at least one of the start-position setting step, the end-position setting step, and the number-of-print-tapes setting step can be serially incremented in units of the print tape and printed through to a last print tape;

an error-cause determination steps of determining the error cause with which the numbering character string input with the condition cannot be serially incremented in units of the print tape and printed through to the last print tape;

an error display step of displaying on the display device, before the start of printing, an error display indicating that the numbering character string cannot be printed through to the last print tape when it is determined that the numbering character string input with the condition is unable to be serially incremented in units of the print tape and printed through to the last print tape;

an error-cause display step of displaying on the display device the error cause display corresponding to the error cause determined by the error-cause determination step; and an error-elimination display step of displaying on the display device the error elimination display corresponding to the error-cause display.

25. A tape making method for serially incrementing and printing a numbering character string having a predetermined arrangement sequential order, such as a numerical, alphabetical, or Japanese syllabary order, in units of a print tape by using a tape printer that comprises a tape feeding mechanism that feeds a long tape; an input device; a display device that displays printing data composed of characters, graphics, and/or the like input or edited by the input device; a printing mechanism that prints the printing data on the tape; and a control circuit that performs drive control of the printing mechanism, wherein the control circuit comprises:

an error-cause display storage section that stores a plurality of error-cause displays individually indicating error causes with which the numbering character string input by the input device cannot be serially incremented in units of the print tape and printed through to the last print tape; and an error-elimination display storage section that stores error-elimination displays indicating ways for eliminating the individual error causes, the method further comprises:

a start-position setting step of specifying a firstly incrementing character of a numbering character string input by the input device;

an end-position setting step of specifying a maximum number of repeatedly incrementable characters or maximum number of repeatedly incrementable digits of the numbering character string;

a number-of-print-tapes setting step of specifying a number of print tapes on which the numbering character string is to be serially incremented and printed;

a numbering-result displaying step of displaying on the display device a numbering character string that is to be printed on a first print tape and a numbering character string that is to be printed on a last print tape;

a determination step of determining before the start of printing whether or not a numbering character string input with a condition specified by at least one of the start-position setting step, the end-position setting step, and the number-of-print-tapes setting step can be serially incremented in units of the print tape and printed through to a last print tape;

an error-cause determination steps of determining the error cause with which the numbering character string input with the condition cannot be serially incremented in units of the print tape and printed through to the last print tape;

an error display step of displaying on the display device, before the start of printing, an error display indicating that the numbering character string cannot be printed through to the last print tape when it is determined that the numbering character string input with the condition is unable to be serially incremented in units of the print tape and printed through to the last print tape;

an error-cause display step of displaying on the display device the error cause display corresponding to the error cause determined by the error-cause determination step; and an error-elimination display step of displaying on the display device the error elimination display corresponding to the error-cause display; and the individual error causes include a cause for a number-of-print-tapes error occurring in an event that the number of print tapes specified in the number-of-print-tapes setting step is an unprintable number of print tapes.

26. A tape making method for serially incrementing and printing a numbering character string having a predetermined arrangement sequential order, such as a numerical, alphabetical, or Japanese syllabary order, in units of a print tape by using a tape printer that comprises a tape feeding mechanism that feeds a long tape; an input device; a display device that displays printing data composed of characters, graphics, and/or the like input or edited by the input device; a printing mechanism that prints the printing data on the tape; and a control circuit that performs drive control of the printing mechanism, wherein the control circuit comprises:

an error-cause display storage section that stores a plurality of error-cause displays individually indicating error causes with which the numbering character string input by the input device cannot be serially incremented in units of the print tape and printed through to the last print tape;

an error-elimination display storage section that stores error-elimination displays indicating ways for eliminating the individual error causes; and a tape-length storage section for pre-storing an initially set tape length of the print tape on which the numbering character string is to be printed, the method further comprises:

a start-position setting step of specifying a firstly incrementing character of a numbering character string input by the input device;

an end-position setting step of specifying a maximum number of repeatedly incrementable characters or maximum number of repeatedly incrementable digits of the numbering character string;

a number-of-print-tapes setting step of specifying a number of print tapes on which the numbering character string is to be serially incremented and printed;

a numbering-result displaying step of displaying on the display device a numbering character string that is to be printed on a first print tape and a numbering character string that is to be printed on a last print tape;

a determination step of determining before the start of printing whether or not a numbering character string input with a condition specified by at least one of the start-position setting step, the end-position setting step, and the number-of-print-tapes setting step can be serially incremented in units of the print tape and printed through to a last print tape;

an error-cause determination steps of determining the error cause with which the numbering character string input with the condition cannot be serially incremented in units of the print tape and printed through to the last print tape;

an error display step of displaying on the display device, before the start of printing, an error display indicating that the numbering character string cannot be printed through to the last print tape when it is determined that the numbering character string input with the condition is unable to be serially incremented in units of the print tape and printed through to the last print tape;

an error-cause display step of displaying on the display device the error cause display corresponding to the error cause determined by the error-cause determination step;

an error-elimination display step of displaying on the display device the error elimination display corresponding to the error-cause display; and a length setting step capable of changing the initially set tape length, which is to be stored into the tape-length storage section, to a new tape length;

the individual error causes include a cause for a number-of-print-tapes error occurring in an event that the number of print tapes specified in the number-of-print-tapes setting step is an unprintable number of print tapes; and a cause for a length error occurring in an event that the tape length to be stored in the tape-length storage section is a length on which the numbering character string cannot be printed.

* * * * *